US009046253B2

(12) United States Patent
Petroski

(10) Patent No.: US 9,046,253 B2
(45) Date of Patent: Jun. 2, 2015

(54) THERMAL BRIDGE FOR LED LUMINAIRES

(75) Inventor: James T. Petroski, Parma, OH (US)

(73) Assignee: GrafTech International Holdings Inc., Independence, OH (US)

( * ) Notice: Subject to any disclaimer, the term of this patent is extended or adjusted under 35 U.S.C. 154(b) by 44 days.

(21) Appl. No.: 13/979,870

(22) PCT Filed: Jan. 27, 2012

(86) PCT No.: PCT/US2012/022982

§ 371 (c)(1),
(2), (4) Date: Jul. 16, 2013

(87) PCT Pub. No.: WO2012/103484

PCT Pub. Date: Aug. 2, 2012

(65) Prior Publication Data

US 2013/0294096 A1 Nov. 7, 2013

Related U.S. Application Data

(60) Provisional application No. 61/437,119, filed on Jan. 28, 2011, provisional application No. 61/527,938, filed on Aug. 26, 2011.

(51) Int. Cl.

| | |
|---|---|
| ***F21V 29/00*** | (2006.01) |
| ***F21S 6/00*** | (2006.01) |
| ***F21V 17/10*** | (2006.01) |
| *F21Y 101/02* | (2006.01) |

(52) U.S. Cl.

CPC ..... *F21V 29/004* (2013.01); *F21S 6/002* (2013.01); *F21V 17/107* (2013.01); *F21Y 2101/02* (2013.01); *F21V 29/70* (2015.01); *F21V 29/85* (2015.01)

(58) Field of Classification Search

CPC ..... F21V 29/004; F21V 29/85; F21V 29/70; F21V 17/107; F21S 6/002; F21Y 2101/02

USPC ..... 362/373, 294, 547, 218, 264, 345; 165/185, 73–74

See application file for complete search history.

(56) References Cited

U.S. PATENT DOCUMENTS

| | | | | |
|---|---|---|---|---|
| 5,091,025 | A | 2/1992 | Murakami et al. | |
| 5,930,116 | A * | 7/1999 | Palmer | 361/704 |
| 6,431,728 | B1 * | 8/2002 | Fredericks et al. | 362/244 |

(Continued)

FOREIGN PATENT DOCUMENTS

WO 2010/113100 A1 10/2010

OTHER PUBLICATIONS

International Search Report and Opinion mailed on Jun. 8, 2012 for International Patent App. No. PCT/US12/022982.

*Primary Examiner* — Anne Hines
*Assistant Examiner* — Jose M Diaz

(57) ABSTRACT

A luminaire includes two housing halves, movable relative to each other between an open and closed configuration. The bottom housing half includes disposed therein a substrate which itself carries at least one LED which transmits light through a window in the bottom housing half. A thermal bridge made of at least one layer of anisotropic thermally conductive graphite is in thermal contact with the substrate and the top housing half when the housing is in the closed configuration, but its disengaged from either the substrate or top housing half when the housing is in the open configuration.

18 Claims, 4 Drawing Sheets

(56) References Cited

U.S. PATENT DOCUMENTS

| | | | | |
|---|---|---|---|---|
| 6,527,422 | B1 | 3/2003 | Hutchison | |
| 7,093,952 | B2 * | 8/2006 | Ono et al. | 362/194 |
| 7,819,551 | B2 | 10/2010 | Ward | |
| 8,057,082 | B2 * | 11/2011 | Seabrook | 362/547 |
| 8,376,582 | B2 * | 2/2013 | Catone et al. | 362/249.03 |
| 8,550,669 | B2 * | 10/2013 | Macwan et al. | 362/366 |
| 8,622,569 | B1 * | 1/2014 | Crookham et al. | 362/145 |
| 8,641,234 | B2 * | 2/2014 | Dube et al. | 362/249.07 |
| 2005/0168941 | A1 | 8/2005 | Sokol et al. | |
| 2005/0180113 | A1 * | 8/2005 | Shirakami et al. | 361/704 |
| 2006/0139891 | A1 | 6/2006 | Gauche et al. | |
| 2008/0285265 | A1 * | 11/2008 | Boissevain | 362/218 |
| 2010/0135007 | A1 * | 6/2010 | Seabrook | 362/218 |
| 2010/0208460 | A1 * | 8/2010 | Ladewig et al. | 362/235 |
| 2010/0296289 | A1 * | 11/2010 | Villard et al. | 362/249.02 |
| 2010/0314081 | A1 * | 12/2010 | Reis et al. | 165/134.1 |
| 2011/0013397 | A1 * | 1/2011 | Catone et al. | 362/244 |
| 2011/0051428 | A1 | 3/2011 | Liu et al. | |

* cited by examiner

THERMAL BRIDGE FOR LED LUMINAIRES

BACKGROUND

LED lighting solutions are becoming increasingly popular for use in both personal and commercial applications. As a consequence, LED lighting is now available in form factors and light intensities small enough for use in a desk lamp or large enough for parking lot or street lighting. Unlike incandescent light bulbs, LED lighting is relatively heat sensitive with temperature thresholds which, if exceeded, could reduce the operating life of the LED. In order to provide sufficient brightness for large area applications, such as parking lot lighting or street lighting, the LED lighting modules have to be of relatively high power. Even considering the increased efficiency of LED lighting when compared to incandescent or fluorescent lighting, with such high power light sources, a significant amount of heat is generated. Thus, for these larger applications, thermal management is an important consideration in avoiding degradation in performance.

SUMMARY OF THE INVENTION

According to one aspect of the present invention, a luminaire includes a bottom housing having a window and a top housing movable relative to the bottom housing between an open configuration and a closed configuration. A substrate carrying at least one LED is positioned in the bottom housing and light from the at least one LED is transmitted through the window. A thermal bridge includes at least one layer of anisotropic thermally conductive graphite and is in thermal contact with the substrate and the top housing when the top housing is in the closed configuration. The thermal bridge is disengaged from thermal contact with the substrate or the top housing when the top housing is in the open configuration.

According to another aspect of the invention, a luminaire includes a bottom housing having a window and a top housing pivotally secured to the bottom housing. The top housing is movable about a pivot axis between an open configuration and a closed configuration. A substrate carries at least one LED. The substrate is positioned in the bottom housing and light from the at least one LED is transmitted through the window. A thermal bridge includes at least one layer of anisotropic thermally conductive graphite and is in thermal contact with the substrate and the top housing. The thermal bridge is also positioned proximate to the pivot axis and bends when moving from the closed to open configuration.

BRIEF DESCRIPTION OF THE DRAWING FIGURES

DETAILED DESCRIPTION OF THE INVENTION

Figure 1:
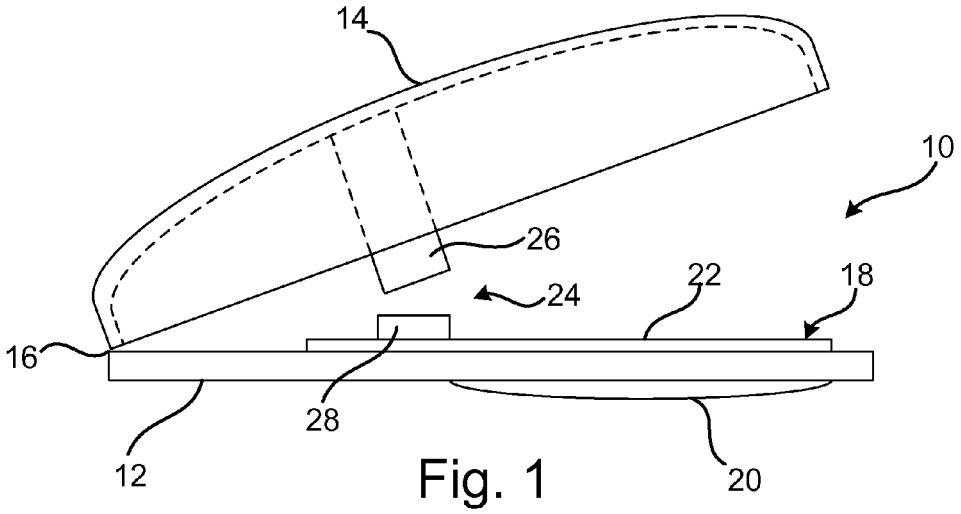
FIG. 1 is a side view of an LED luminaire.

The present disclosure relates to a luminaire having a thermal management system for removing heat from an LED module. In particular, the thermal management system removes heat directly to an outer housing wall on an opposed side of the housing from the heat source. The luminaire may be any style, but is advantageously a large form factor luminaire, adapted for use in street or parking lot lighting applications. The LED module may include one or more LEDs mounted on a printed circuit board which powers and controls the illumination of the LED(s). In one embodiment, the LED module produces at least about 3,000 lumens. In another embodiment, the LED module produces at least about 5,000 lumens. In another embodiment, the LED module produces at least about 7,500 lumens. In still other embodiments, the LED module produces at least about 10,000 lumens.

In an embodiment, the thermal management system includes a thermal bridge and optionally a heat collector. The thermal bridge is in thermal contact with the LED module to move heat from the LED module to the housing wall opposed from the LED module to reduce the effect of the heat on components of the LED module. In one embodiment, the thermal bridge extends directly across the interior of the housing from the LED module to the opposed housing wall. In this manner, the thermal bridge moves the heat to relatively distant portions of the housing and safely away from the LED module.

In an embodiment, the thermal bridge is configured to disengage when the housing is opened and thereafter, engage the housing wall or LED module when the housing is closed. In these or other embodiments, the thermal bridge disengages without the need to remove additional mechanical fasteners. In one embodiment, the thermal bridge includes a knife extending from one housing half and engaging a receiving portion secured to the LED module. In other embodiments, the thermal bridge includes a biased member extending between the LED module and top housing, the biased member being compressed when the luminaire housing is closed. In still other embodiments, the thermal bridge includes a flexible member positioned proximate to the pivot axis between the LED module and top housing.

In some embodiments the thermal bridge is formed of one or more sheets of compressed particles of exfoliated graphite with one or more support layers. In other embodiments, the thermal bridge includes one or more layers of pyrolytic graphite with one or more support layers. In still other embodiments, the thermal bridge may be formed of both pyrolitic graphite and one or more sheets of compressed particles of exfoliated graphite. By "pyrolytic graphite" is meant graphitized polyimide sheet, for instance, in U.S. Pat. No. 5,091,025, the disclosure of which is incorporated herein by reference. The support layers may be any material with sufficient strength to support the thermal bridge, including, for example, metals or plastic materials. The compressed exfoliated graphite materials, such as graphite sheet and foil, are coherent, with good handling strength, and are suitably compressed, e.g. by roll pressing, to a thickness of about 0.05 mm to 3.75 mm and a typical density of about 0.4 to 2.0 g/cc or higher. When employed in a thermal bridge in accordance with the current disclosure, a sheet of compressed particles of exfoliated graphite should have a density of at least about 0.6 g/cc, more preferably at least about 1.1 g/cc, most preferably at least about 1.6 g/cc. The upper limit to the density of the graphite sheet heat spreader is about 2.0 g/cc. One graphite sheet suitable for use in the thermal bridge in the present disclosure is commercially available as eGRAF® material, from GrafTech International Holdings Inc. of Parma, Ohio.

If desired, sheets of compressed particles of exfoliated graphite can be treated with resin and the absorbed resin, after curing, enhances the moisture resistance and handling strength, i.e. stiffness, of the graphite article as well as "fixing" the morphology of the article. Suitable resin content is preferably at least about 5% by weight, more preferably about 10 to 35% by weight, and suitably up to about 60% by weight. Resins found especially useful in the practice of the present invention include acrylic-, epoxy- and phenolic-based resin systems, fluoro-based polymers, or mixtures thereof. Suitable epoxy resin systems include those based on diglycidyl ether of bisphenol A (DGEBA) and other multifunctional resin systems; phenolic resins that can be employed include resole and novolac phenolics. Optionally, the flexible graphite may be impregnated with fibers and/or salts in addition to the resin or in place of the resin. Additionally, reactive or non-reactive additives may be employed with the resin system to modify properties (such as tack, material flow, hydrophobicity, etc.).

In certain embodiments, a plurality of graphite sheets may be laminated into a unitary article for use in the thermal management system disclosed herein. The sheets of compressed particles of exfoliated graphite may be laminated with a suitable adhesive, such as pressure sensitive or thermally activated adhesive, therebetween. The adhesive chosen should balance bonding strength with minimizing thickness, and be capable of maintaining adequate bonding at the service temperature at which heat transfer is sought. Suitable adhesives would be known to the skilled artisan, and include acrylic and phenolic resins.

The graphite sheet(s) should have an in-plane thermal conductivity of at least 150 W/m*K. In still other embodiments, the graphite sheet exhibits an in-plane thermal conductivity of at least 300 W/m*K. In still other embodiments the graphite sheet exhibits an in-plane thermal conductivity of at least 400 W/m*K. In still other embodiments the graphite sheet exhibits an in-plane thermal conductivity of at least 600 W/m*K. In still other embodiments the graphite sheet exhibits an in-plane thermal conductivity of at least 700 W/m*K. In still other embodiments, the graphite sheet exhibits an in-plane thermal conductivity of at least 1500 W/m*K. In one embodiment, the graphite sheet material may be from 10 to 1500 microns thick.

The thermal management system may optionally include a heat sink positioned in thermal contact with the LED module and between the LED module and thermal bridge. In embodiments including a heat sink, the thermal energy from the LED module is collected by the heat sink, and thereafter transmitted to the opposed housing wall through the thermal bridge. The heat sink should be isotropic and is advantageously a metal element, such as copper or aluminum, or alloys thereof. According to the present disclosure, isotropic means that the material from which the heat collector is formed has a thermal anisotropic ratio of no more than 2.0, preferably less than 2.0, more preferably no more than 1.5, and even more preferably about 1.0. In a certain embodiment, the thermal anisotropic ratio of the heat sink may range from about 1.0 up to about 2.0.

In embodiments including a heat sink, the heat sink may be positioned in thermal contact with the LED module. Advantageously, the heat sink may be generally planar shaped and positioned proximate to the LED(s) of the LED module; in certain embodiments of the thermal management system disclosed herein, the heat sink is in thermal contact with the printed circuit board of the LED module, and acts as an agent to transfer heat from the LED(s) to the thermal bridge.

As used herein, thermal contact means that a first component is positioned in relation to a second component such that heat is transferred therebetween. Physical contact is the preferred form of thermal contact, although a housing, circuit board, or a heat transfer element, such as a thermal interface material or the like may be positioned between the first component and the second component to facilitate thermal transfer. In certain embodiments, an adhesive may be used to maintain the thermal interface material in position, or in some embodiments, an adhesive can be used to ensure good contact between the heat sink or thermal bridge and the LED module, or the heat sink and the thermal bridge, is maintained.

In one embodiment, the material used to form the heat sink has two major surfaces and a thermal conductivity of at least 10 W/m*K in order to draw sufficient heat from the LED module. In other embodiments, the thermal conductivity of the material used to form the heat collector is at least 100 W/m*K. As noted, in some embodiments, the metal can be aluminum, copper, or alloys thereof.

With reference now to FIG. 1 an LED luminaire is shown and generally indicated by the numeral 10. Luminaire 10 includes a bottom housing 12 that is detachably connected to a top housing 14. Accordingly, luminaire may be placed in an open configuration, for example, FIG. 1, wherein the interior portion of luminaire 10 is exposed. Luminaire may also be placed in a closed configuration (not shown) wherein the lower housing 12 and upper housing 14 are secured together in a manner that substantially encloses an interior volume.

In one embodiment, bottom housing 12 may be pivotally attached to top housing 14 at a pivot point 16 (by, for example, a hinge or the like). In other embodiments, the bottom housing 12 may be completely detached from top housing 14. Top housing 14 may be made of any materials, but in one particular embodiment is made of a thermally conductive material. For example, top housing 14 may be made of a metal such as, for example, aluminum or steel. Alternately, top housing may be made of a thermally conductive plastic. The thermal conductivity of the plastic may be increased buy, for example, adding thermally conductive additives thereto.

Bottom housing 12 carries an LED light module 18 that includes one or more LEDs that generate light which is transmitted through a clear or translucent protective window 20. The LED module 18 may include a substrate 22 such as, for example, a printed circuit board upon which the LED(s) and optionally power and control electronics are disposed. Substrate 22 may be generally planar and sized to fit on or inside of lower housing 12. Heat generated by the LED(s) and power electronics is advantageously removed from the LED module 18 by a thermal bridge 24. Advantageously, thermal bridge 24 moves thermal energy from LED module 18 to top housing 14 where it may be radiated or otherwise removed from luminaire 10.

Thermal bridge 24 may generally include a blade 26 and a receiver 28. Blade 26 is secured to top housing 14 and extends downwardly therefrom toward substrate 22. Receiver 28 extends upwardly from substrate 22 and is positioned thereon to engage blade 26 when lower housing 12 and upper housing 14 are engaged and in the closed configuration. It should be appreciated that the configuration of blade 26 and receiver 28 may be reversed, wherein the blade 26 extends upwardly from substrate 22 and the receiver 28 may be secured to, and extend downwardly from, the top housing 14.

Receiver 28 may be secured to any location on substrate 22. Receiver 28 is advantageously secured at a location on the substrate 22 proximate to the downwardly facing LED(s). In this or other embodiments, the receiver 28 is secured on the substrate 22 at a position at least partially overlapping the position of one or more LED(s). In this or other embodiments, the receiver 28 is positioned over the portion of the LED module 18 that generates the greatest amount of heat.

Figure 2:
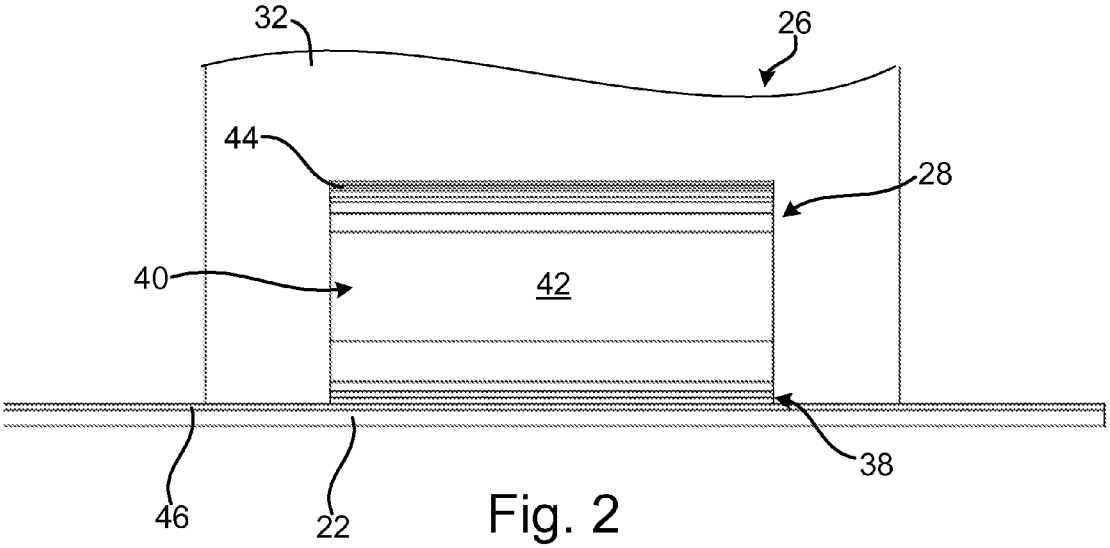
FIG. 2 is a front magnified view of a blade and receiver in accordance with one aspect of the disclosed embodiment.
Figure 3:
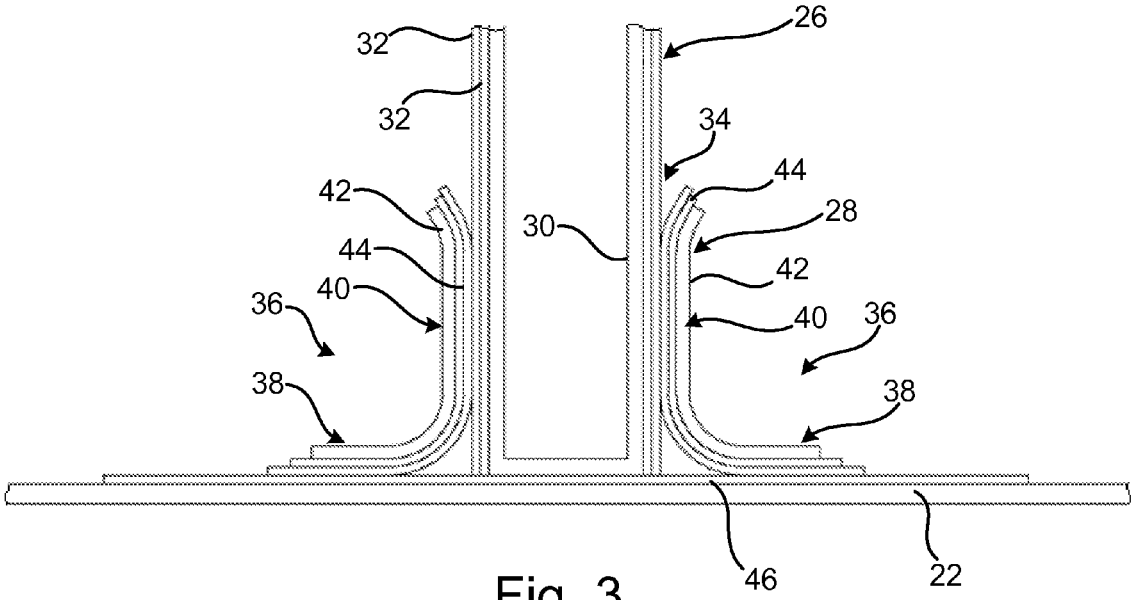
FIG. 3 is a side view of the blade and receiver of FIG. 2.

With reference now to FIGS. 2 and 3, blade 26 may be generally U-shaped in cross-section with an inner structural layer 30 and one or more thermally conductive layers 32 positioned outwardly of layer 30. Structural layer 30 provides structural support for the blade and may be made of any appropriate material. For example, layer 30 may be a plastic material or metal such as aluminum. Thermally conductive layer 32 may be made of graphite based materials described herein above.

Though the blade 26 is shown having a generally U-shaped cross-section, it should be appreciated that other blade configurations are suitable. For example, blade 26 may be generally planar and include a single interior structural support layer made of a plastic or metal material and a thermally conductive layer secured to both major surfaces. In still other embodiments, no structural support layer is provided, and the blade 26 is made from one or more thermally conductive layers.

Receiver 28 includes a channel 34 that is sized to at least partially receive blade 26 therein. Receiver 28 includes a pair of spaced apart opposed legs 36 that are generally L-shaped in cross-section as shown in FIG. 3. A first portion 38 extends approximately parallel to at least a portion of substrate 22. In one embodiment, first portion 38 is secured directly to the substrate 22 and is consequently in direct thermal contact therewith. In another embodiment, a heat sink may be provided between receiver 28 and substrate 22. A second portion 40 extends upwardly from first portion 38 to define the channel 34 and engage blade 26. In one embodiment, second portion 40 extends upwardly at a generally 90 degree angle from first portion 38. Channel 34 is advantageously sized slightly smaller, in cross-section, than the cross-sectional width of blade 26 so that an interference fit ensures good thermal coupling. To that end, legs 36 may be resilient to allow flexural movement during insertion of blade 26.

Each leg 36 may include a structural support layer 42 which provides structural support for the leg 36 and may be made of any appropriate material. For example, layer 42 may be a plastic material or metal such as aluminum. At least one contiguous layer 44 of thermally conductive material is secured to the interior facing and bottom facing surfaces of structural support layer 42. In this manner the thermally conductive layer 44 is in thermal contact with substrate 22 and with the exterior surfaces of blade 26 when inserted into channel 34.

In on embodiment, an optional interface material 46 may be provided between receiver 28 and substrate 22. Interface material 46 may be a graphite material as described herein above. In other embodiments, interface material 46 may be a heat sink as described herein above.

As should be appreciated, when top housing 14 is lowered, blade 26 as at least partially received inside channel 34. Thermally conductive layers 32 of blade 26 engage thermally conductive layers 44 of receiver 28. In this manner a thermal bridge is formed between substrate 22 and the upper housing 14 to which the thermal bridge is in thermal contact. Thermal energy may then flow along blade 26 and be dispersed at upper housing 14. In this manner, the thermal energy generated by the LED and power electronics on substrate 22 is removed.

Figure 4:
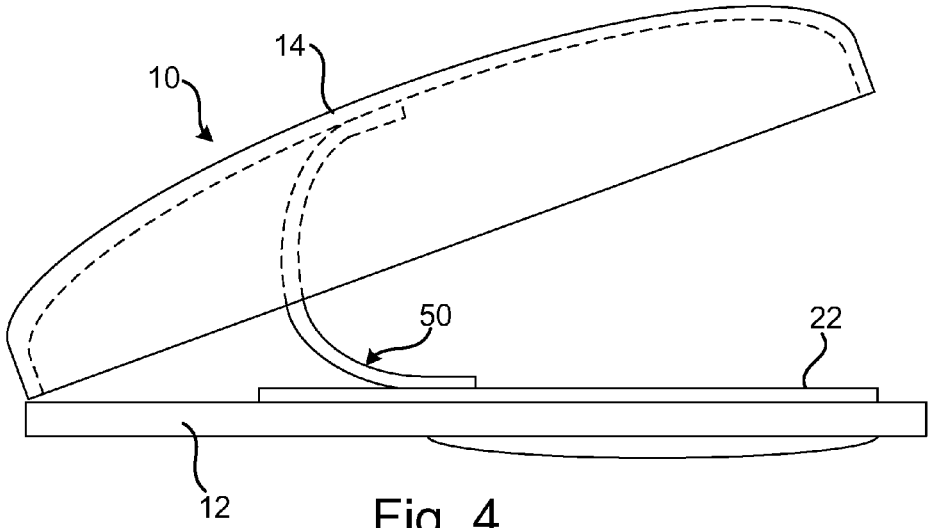
FIG. 4 is a side view of a second embodiment of an LED luminaire.
Figure 5:
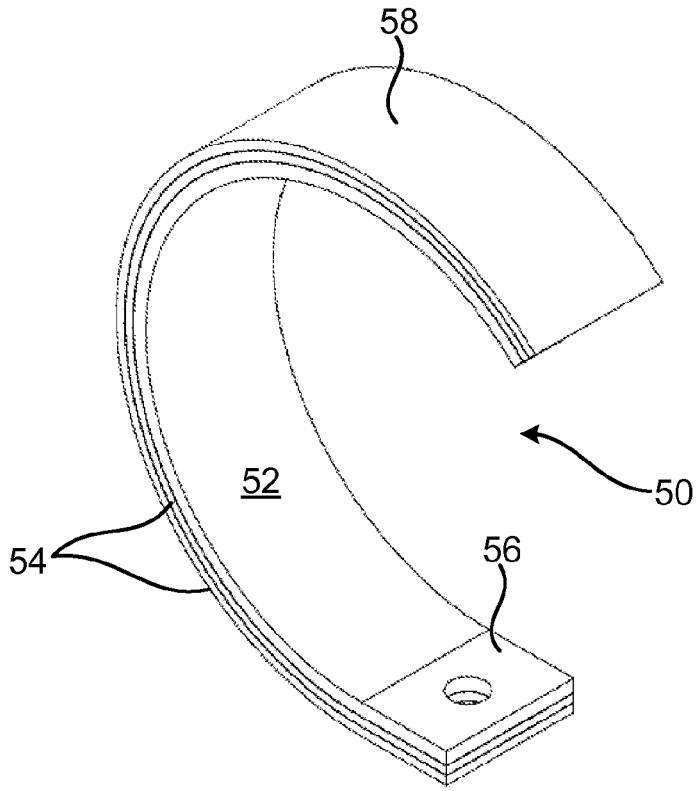
FIG. 5 is an isometric view of a thermal bridge.
Figure 6:
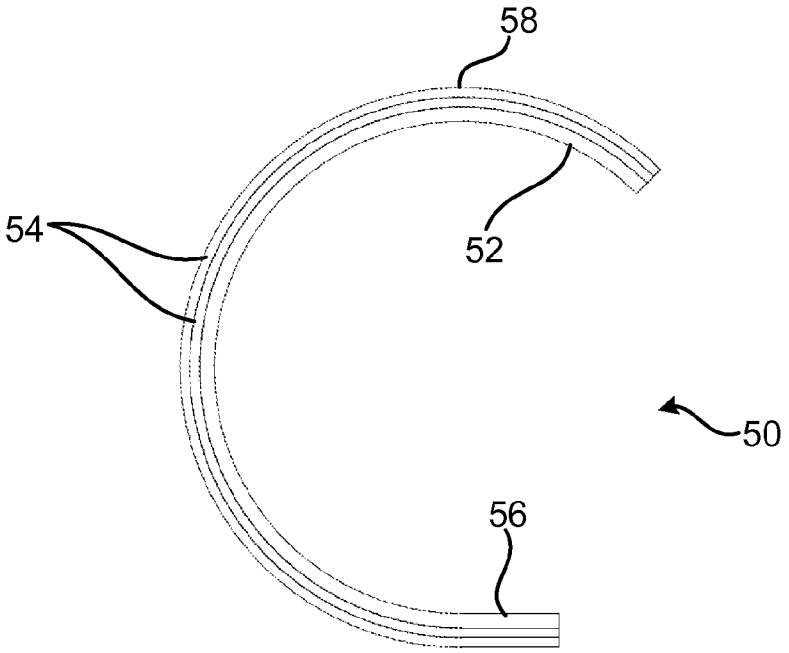
FIG. 6 is a side view of the thermal bridge of FIG. 5.

With reference now to FIGS. 4-6, a second embodiment is shown wherein like numerals indicate like elements. Luminaire 10 includes thermal bridge 50 which may be generally C-shaped with an inner structural layer 52 and one or more thermally conductive layers 54 positioned outwardly of layer 52. Structural layer 52 provides structural support for the thermal bridge 50 and may be made of a generally resilient material. For example, layer 52 may be made of a resilient plastic or a metal. Structural layer 52 may be optionally thermally conductive. Thermally conductive layer 54 may be a graphite material discussed herein above. It should be appreciated that other cross-sectional shapes of the thermal bridge 50 are contemplated. For example, bridge 50 may be tenerally T-shaped or generally L-shaped in cross-section.

A bottom portion 56 of thermal bridge 50 is advantageously secured directly to substrate 22 in any manner, for example, adhesive or mechanical fasteners. In other embodiments, a heat sink (not shown) may be positioned between thermal bridge 50 and substrate 22 so that thermal bridge 50 is in thermal contact with substrate 22 through the heat sink. Thermal bridge 50 is sized so that, when top housing 14 is secured to bottom housing 12 in the closed configuration, a top portion 58 of thermal bridge 50 engages the top housing 14. Because thermal bridge 50 is generally resilient, the thermal bridge 50 will elastically deform, and because of the bias force, bring the thermally conductive layer 54 firmly into engagement with top housing 14. In this manner, thermal energy generated by the LED and/or power electronics is transferred from substrate 22 to the top housing 14.

It should be appreciated that thermal bridge 50 may be secured instead to top housing 14. Accordingly, when bottom housing 12 and top housing 14 are in the closed configuration, the thermal bridge 50 engages the substrate 22 and is elastically compressed thereupon to bring thermal bridge 50 into thermal contact with substrate 22.

Figure 7:
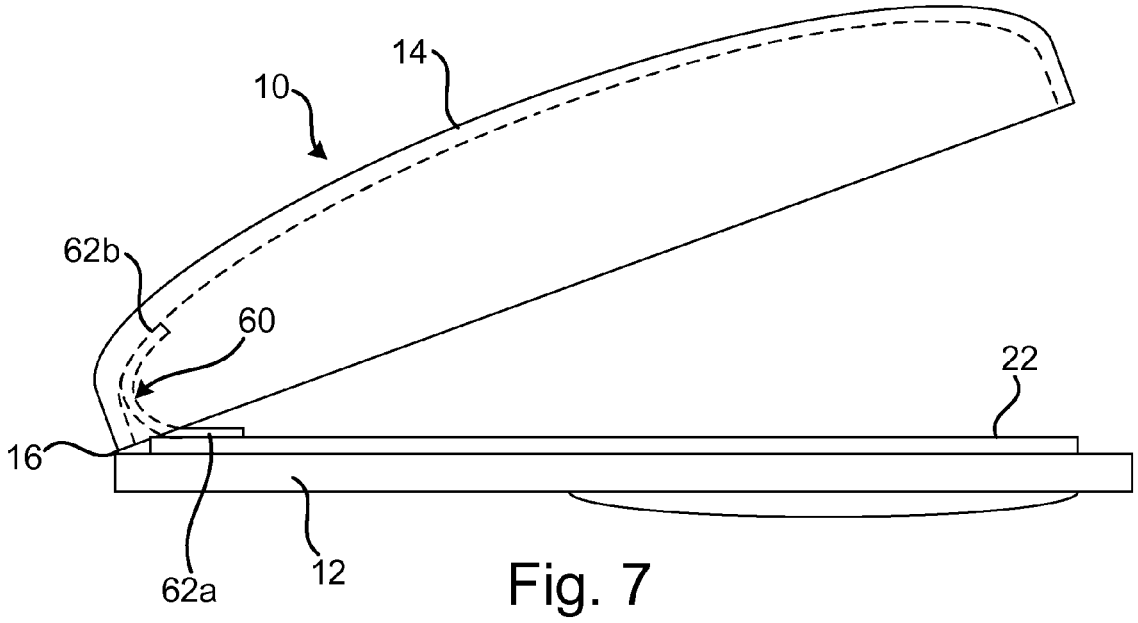
FIG. 7 is a side view of a third embodiment of an LED luminaire.

With reference now to FIG. 7, a third embodiment is shown wherein like numerals indicate like elements. Luminaire 10 includes thermal bridge 60 which may be generally C-shaped. Thermal bridge 60 is positioned proximate to the pivot point 16 and is secured at opposed ends 62*a* and 62*b* to the substrate 22 and top housing 14 respectively. In one embodiment thermal bridge 60 wraps around the pivot point 16. In other embodiments, the thermal bridge 60 is proximate to, but not wrapped around pivot point 16. Thermal bridge 60 is flexible and resilient and therefore, when the top housing 14 is moved from the closed to open configuration, thermal bridge 60 flexes to enable unencumbered pivoting motion. In one embodiment, thermal bridge 60 biases the top housing 14 toward the open configuration. In this manner, the top housing 14 may be held open during servicing. In other embodiments, the thermal bridge 60 provides minimal biasing force on top housing 14.

Thermal bridge 60 may comprise one or more conductive layers such as the graphite material discussed herein above. Further, in one embodiment, thermal bridge 60 may additionally include one or more structural layers to provide structural support for the thermal bridge 60 and may be made of a generally resilient material. For example, the structural layer may be made of a resilient plastic or a metal. As discussed above, the bottom end 62*a* of thermal bridge 60 is advantageously secured directly to substrate 22 in any manner, for example, adhesive or mechanical fasteners. In other embodiments, a heat sink (not shown) may be positioned between thermal bridge 60 and substrate 22 so that thermal bridge 60 is in thermal contact with substrate 22 through the heat sink. Likewise, at least a portion of thermal bridge 60 is advantageously secured to the interior surface of top housing 14. In this manner, thermal energy generated by the LED and/or power electronics is transferred from substrate 22 to the top housing 14.

The various embodiments described herein can be practiced in any combination thereof. The above description is intended to enable the person skilled in the art to practice the invention. It is not intended to detail all of the possible variations and modifications that will become apparent to the skilled worker upon reading the description. It is intended, however, that all such modifications and variations be included within the scope of the invention that is defined by the following claims. The claims are intended to cover the indicated elements and steps in any arrangement or sequence that is effective to meet the objectives intended for the invention, unless the context specifically indicates the contrary.

What is claimed is:

1. A luminaire comprising:

a bottom housing having a window;

a top housing movable relative to said bottom housing between an open configuration and a closed configuration;

a substrate carrying at least one LED, said substrate being positioned in said bottom housing and light from said at least one LED transmitted through said window; and a thermal bridge comprising a plastic structural layer and at least one layer of anisotropic thermally conductive graphite, said graphite being in thermal contact with said substrate and said top housing when said top housing is in the closed configuration and said graphite being disengaged from thermal contact with one of said substrate and said top housing when said top housing is in the open configuration, wherein said graphite comprises at least one of one or more sheets of compressed particles of exfoliated graphite and one or more sheets of pyrolytic graphite.

2. The luminaire according to claim 1 wherein said thermal bridge further comprises a blade secured to one of said substrate and said top housing and a receiver secured to the other of said substrate and said top housing, wherein said receiver includes a pair of spaced apart L-shaped legs forming a channel sized to at least partially receive said blade therein.

3. The luminaire according to claim 2 wherein said blade includes an inner structural layer formed of said plastic structural layer and said at least one layer of anisotropic thermally conductive graphite is disposed on opposed sides of said inner structural layer.

4. The luminaire according to claim 2 wherein said blade comprises a generally U-shaped cross-section having an inner structural layer formed of said plastic structural layer and said at least one layer of anisotropic thermally conductive graphite positioned outwardly of said inner structural layer.

5. The luminaire according to claim 2 wherein each of said legs comprises a first portion secured generally parallel to said substrate and a second portion extending generally perpendicular to said substrate.

6. The luminaire according to claim 5 wherein each of said legs includes an outer plastic structural layer and at least one layer of anisotropic thermally conductive graphite extending along said first portion and said second portion and in thermal contact with said substrate.

7. The luminaire according to claim 1 wherein said thermal bridge comprises generally resilient material affixed to said substrate and positioned to be compressed against said top housing when said top housing the closed configuration.

8. The luminaire according to claim 7 wherein said thermal bridge is generally C-shaped and includes an inner structural layer formed of said plastic structural layer and at least one outer layer of anisotropic thermally conductive graphite.

9. The luminaire according to claim 8, wherein said thermal bridge provides a bias force pushing said top housing toward the open configuration.

10. The luminaire according to claim 1 wherein said at least one LED produces at least 5000 lumens.

11. The luminaire according to claim 1 wherein said at least one LED produces at least 10000 lumens.

12. The luminaire according to claim 1 further comprising a hinge, wherein said bottom housing is attached to said top housing at said hinge.

13. A luminaire comprising:

a bottom housing having a window;

a top housing pivotally secured to said bottom housing and movable about a pivot axis between an open configuration and a closed configuration;

a substrate carrying at least one LED, said substrate being positioned in said bottom housing and light from said at least one LED transmitted through said window;

a thermal bridge comprising at least one layer of anisotropic thermally conductive graphite and being in thermal contact with said substrate and said top housing and positioned proximate to said pivot axis, wherein said thermal bridge provides a bias force pushing said top housing toward the open configuration.

14. The luminaire of claim 13 wherein said thermal bridge is wrapped around said pivot axis.

15. The luminaire of claim 13 wherein said thermal bridge is positioned forwardly of and not wrapped around said pivot axis.

16. The luminaire of claim 13 wherein said thermal bridge is generally C-shaped and includes an inner structural layer and at least one outer layer of anisotropic thermally conductive graphite.

17. The luminaire according to claim 13 wherein said anisotropic thermally conductive graphite comprises one or more sheets of compressed particles of exfoliated graphite.

18. The luminaire according to claim 13 wherein said anisotropic thermally conductive graphite comprises one or more sheets of pyrolytic graphite.

* * * * *